US006273065B1

(12) United States Patent
Carpenter

(10) Patent No.: US 6,273,065 B1
(45) Date of Patent: Aug. 14, 2001

(54) ELECTRONICALLY CONTROLLED CARBURETOR

(75) Inventor: Todd L. Carpenter, Gregory, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 09/484,999

(22) Filed: Jan. 18, 2000

Related U.S. Application Data

(63) Continuation of application No. 08/988,936, filed on Dec. 11, 1997, now Pat. No. 6,076,503.
(60) Provisional application No. 60/032,873, filed on Dec. 13, 1996.

(51) Int. Cl.[7] ..... F02M 7/10; F02D 41/14
(52) U.S. Cl. ..... 123/436; 123/438
(58) Field of Search ..... 123/437, 438, 123/441, 436; 261/DIG. 74

(56) References Cited

U.S. PATENT DOCUMENTS

| | | | | |
|---|---|---|---|---|
| 1,361,771 | | 12/1920 | O'Malley . | |
| 3,186,397 | | 6/1965 | Loudon | 123/148 |
| 3,464,397 | | 9/1969 | Burson | 123/148 |
| 3,534,722 | | 10/1970 | Burson | 123/148 |
| 3,612,023 | | 10/1971 | Sohner | 123/149 A |
| 3,861,366 | | 1/1975 | Masaki et al. | 123/119 R |
| 4,217,314 | * | 8/1980 | Dysarz | 261/50 R |
| 4,232,643 | | 11/1980 | Leshner et al. | 123/440 |
| 4,270,503 | * | 6/1981 | Pomerantz | 123/438 |
| 4,303,049 | * | 12/1981 | Ikeura et al. | 123/440 |
| 4,368,707 | | 1/1983 | Leshner et al. | 123/436 |
| 4,430,973 | | 2/1984 | Miyagi | 123/339 |
| 4,538,586 | | 9/1985 | Miller | 123/620 |
| 4,700,679 | | 10/1987 | Otobe et al. | 123/327 |
| 4,793,306 | | 12/1988 | Swain | 123/308 |
| 4,827,887 | | 5/1989 | Leshner | 123/493 |
| 4,870,944 | | 10/1989 | Matsumoto et al. | 123/585 |
| 5,117,794 | | 6/1992 | Leshner et al. | 123/444 |
| 5,161,496 | | 11/1992 | Matsushima et al. | 123/185.3 |
| 5,251,597 | | 10/1993 | Smith et al. | 123/339 |
| 5,251,601 | | 10/1993 | Leshner | 123/436 |
| 5,261,368 | | 11/1993 | Umemoto | 123/327 |
| 5,381,771 | | 1/1995 | Leshner | 123/436 |
| 5,445,014 | | 8/1995 | Fiorenza, II et al. | 73/117.3 |
| 5,476,082 | | 12/1995 | Carpenter et al. | 123/478 |
| 5,513,619 | | 5/1996 | Chen et al. | 123/601 |
| 5,809,971 | * | 9/1998 | Svensson et al. | 123/438 |

* cited by examiner

*Primary Examiner*—Andrew M. Dolinar
*Assistant Examiner*—Arnold Castro
(74) *Attorney, Agent, or Firm*—Baker & Daniels

(57) ABSTRACT

The present invention involves a carbureted fuel system for an internal combustion engine for small utility implements. The engine includes a crankcase with a cylinder bore. The crankcase rotatably supports a crankshaft having a flywheel and a magnet disposed on an outer periphery of the flywheel. The crankshaft is also connected to a reciprocating piston disposed in the cylinder bore. A cylinder head is attached to the crankcase over the cylinder bore, and a carburetor is disposed on the cylinder head. The carburetor is in communication with a fuel supply and an air inlet. The carburetor includes a mixing chamber in which the fuel and air are mixed together and then introduced into the manifold and eventually into the cylinder via a valve for combustion therein. In communication with the main passage of the carburetor is a secondary air inlet in which is disposed an air bleed device, such as a solenoid or PZT operated actuator, which is controlled by an electronic control unit. An induction coil is disposed adjacent the flywheel and is coupled to the electronic control unit so that the rotation of the flywheel generates a pulse on the induction coil that is processed by the electronic control unit. Based upon the information derived from the electrical pulses generated by the induction coil, the electronic control unit activates the air bleed device to enrich or enlean the air-to-fuel mixture fed into the cylinder for combustion. In this manner emissions associated with the operation of the engine may be reduced.

8 Claims, 12 Drawing Sheets

ELECTRONICALLY CONTROLLED CARBURETOR

CROSS REFERENCE TO RELATED APPLICATIONS

This is a continuation of application Ser. No. 08/988,936, filed Dec. 11, 1997 issued as U.S. Pat. No. 6,076,503 on Jun. 20, 2000.

This application claims the benefit under Title 35, U.S.C. §119(e) of U.S. Provisional Patent Application Ser. No. 60/032,873, entitled ELECTRONICALLY CONTROLLED CARBURETOR, filed on Dec. 13, 1996.

FIELD OF THE INVENTION

The present invention generally relates to carbureted fuel systems for small utility engines, and more particularly relates to an electronically controlled fuel delivery system for adjusting the air to fuel ratio of the combustible material supplied to an engine by a carburetor based on the operating characteristics of the engine.

BACKGROUND OF THE INVENTION

It is known that the operating characteristics of utility engines (e.g., emissions, power, smoothness, etc.) are influenced by the air to fuel ratio of the fuel. Under high load conditions, a rich mixture is desirable. Under low loads, a lean mixture improves engine emissions performance. Heretofore, control of the air to fuel ratio was accomplished using a carbureted air bleed mechanism which varied the quantity of air delivered to the engine cylinder in relation to the stability of the engine.

SUMMARY OF THE INVENTION

The present invention provides an electronically controlled carburetor and ignition system for a small utility engine, such as a four stroke cycle engine, which uses mechanically generated energy to adjust the air to fuel ratio of the fuel delivered to the cylinder by actuating an air solenoid to vary the vacuum in the carburetor idle mixing chamber. During engine start-up, a magnet carried by the flywheel creates electrical pulses as it rotates past a charge coil and a trigger coil. The coils are positioned so that the charge pulse charges a capacitor during the compression stroke and the trigger pulse discharges the capacitor near the top of the compression stroke, thereby igniting the compressed mixture. When the engine reaches operating speed, the charge pulse also powers an engine control unit (ECU) which alternates the capacitor discharge between the spark plug and the air solenoid. The ECU thereby uses the energy from the capacitor discharge to operate the air solenoid during the exhaust/intake revolution of the flywheel to prepare the air/fuel mixture for the next ignition. The ECU calculates the optimum air to fuel ratio by monitoring the pulses generated by the charge coil which is an indication of the engine speed, load and stability.

The electronic feedback carburetor is described herein for use with a single cylinder, 4 stroke cycle engine, but may be used in conjunction with a variety of engine applications. There are two variations of the concept as described. The variations are different in the type of actuator used (solenoid or piezo-electric) and the electronics are consequently slightly different. Referring to FIG. 1, the control air volume is controlled by means of pulse width modulation with an air solenoid valve or other equivalent actuator. The use of piezo-electric (PZT) actuation for the air bleed function is a unique application of such technology. The timing of the actuation of the solenoid valve shall be determined by an electrical impulse that occurs once per revolution from a conventional flywheel magnet utilized in spark delivery for small, single-cylinder, air-cooled utility engines. The flywheel magnet charges a capacitor for spark and/or air solenoid actuation through a single primary winding and also charges a constant voltage power supply for the engine control unit (ECU) computer through a second winding.

The invention utilizes external power from a battery supply to power the air bleed solenoid. The pulse on the primary winding is utilized as a sensor to determine speed feedback, load feedback and engine stability by the following methods: speed feedback is accomplished by measuring the time the period between pulses; load feedback will be accomplished by the difference in the period between the power stroke and the exhaust stroke because the higher the engine load, the longer the period difference that is detected; and engine stability (primarily due to carburetion enleanment) will be determined by the fluctuation in time periods of the power strokes from one cycle to the next.

Additional features in the system include provisions for a variable timing ignition by means of positioning the charge coil several degrees in advance of the desired spark location. Then the engine speed can be used to calculate the desired spark angle. The spark will be initiated near the top dead center position (TDC) of piston 14 via trigger coil 24 such that if no spark signal comes from the ECU (due to low charge conditions at startup), then trigger coil 24 will fire the ignition via trigger control 62 and primary ignition transformer 72.

The variable timing feature allows for provisions for a flywheel brake. When shutdown occurs, the ECU does not channel energy to the carburetor air bleed solenoid, but delays the spark on the intake stroke long enough to be a very advanced spark during the compression stroke to facilitate combustion and resist the forward motion of the engine.

DESCRIPTION OF THE INVENTION

The embodiments disclosed below are not intended to be exhaustive or limit the invention to the precise forms disclosed. Rather, the embodiments are chosen and described so that others skilled in the art may utilize their teachings.

Figure 1:
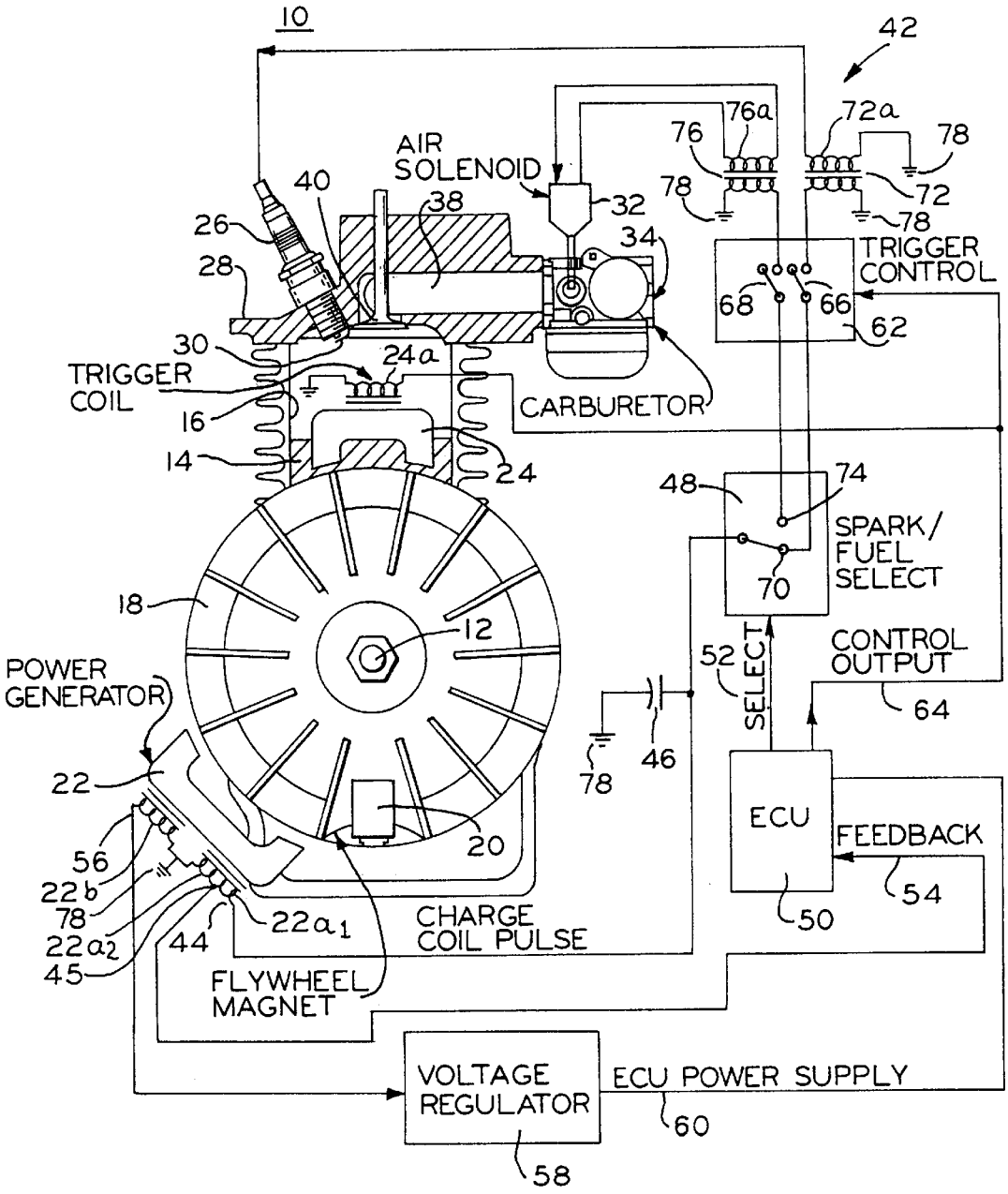
FIG. 1 is a schematic view of the electronically controlled carburetor of the present invention utilizing a solenoid actuator device for trimming the air mixture.

The present invention 10 relates to a utility engine such as the four stroke cycle engine show in FIG. 1. The basic structure and operation of the engine is described in U.S. Pat. No. 5,476,082, which is incorporated herein by reference, except that the engine of the present invention is carbureted whereas the engine of U.S. Pat. No. 5,476,082 is fuel injected. Engine crankshaft 12 is connected to piston 14 which reciprocates within cylinder 16 in a conventional manner. Crankshaft 12 is also rotatably connected to flywheel 18 which carries ignition magnet 20 at its outer periphery. Charge coil lamination 22 and trigger coil 24 lamination are disposed just outside the outer perimeter of flywheel 18 at precise angular spacing to ensure that combustion occurs at the desired time in the power stroke as described in further detail below. Lamination 22 and trigger coil 24 act as magnetic receivers in the form of metallic laminations forming poles. Accordingly, when ignition magnet 20 rotates past laminations 22, 24, electric fields are generated within the windings of coils 22$a_1$, 22$a_2$, 22*b*, and 24*a*, respectively. The secondary windings are connected to the electronic control circuit.

Figure 6:
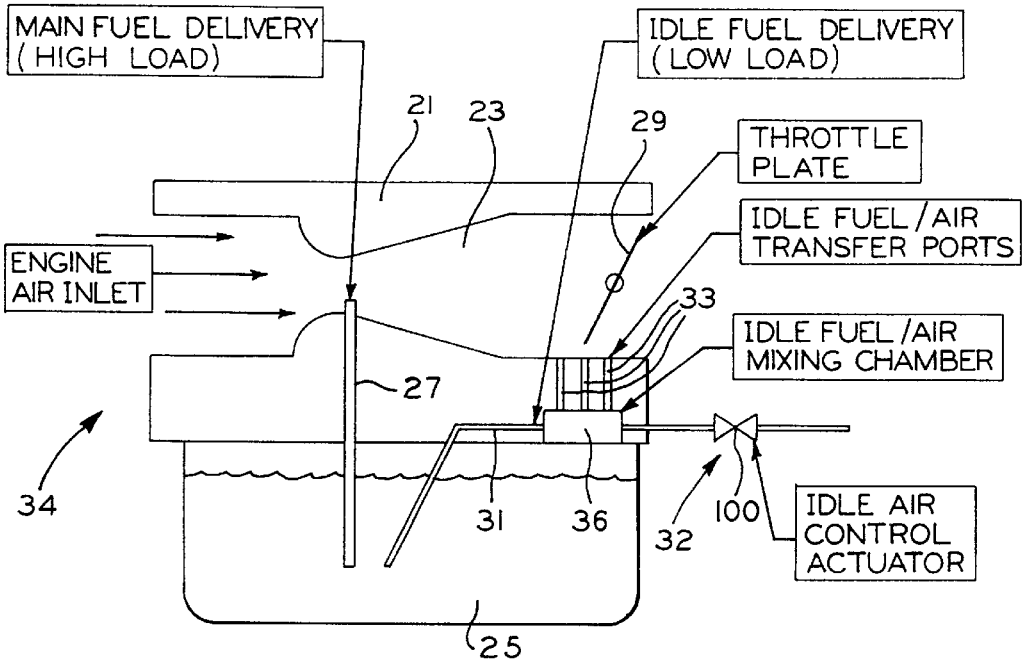
FIG. 6 is a schematic view of a carburetor according to the present invention.
Figure 7:
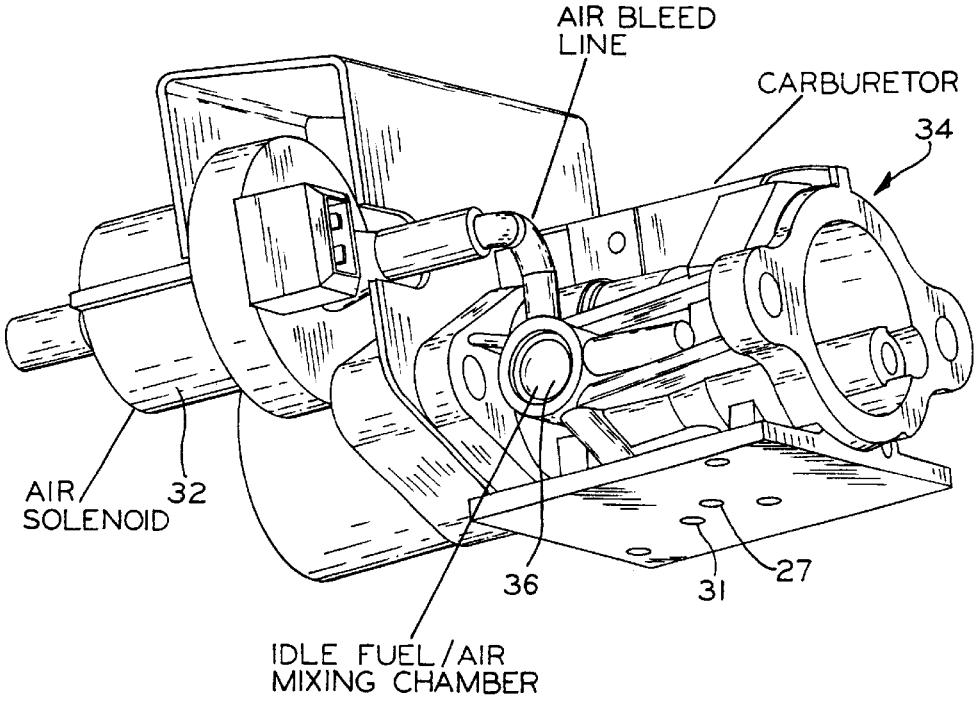
FIG. 7 is a perspective view of the carburetor shown in FIG. 6.

Spark plug 26 is mounted on crankcase 28 in a conventional manner so that sparking gap 30 extends into cylinder 16. Fuel, e.g. gasoline, propane, or other suitable material, is drawn into carburetor 34 upon every other rotation of the engine (not shown) camshaft. As best shown in FIG. 6, carburetor 34 includes a housing 21 which defines a main passage 23 in which are drawn air from the atmosphere and fuel from float bowl 25 through main fuel delivery passage 27. Throttle plate 29 controls the flow rate through main passage 23. Carburetor 34 also includes mixing chamber 36 which draws fuel from bowl 25 through idle fuel delivery passage 31 and air from the atmosphere through air solenoid 32, such as part number 0280142300 as manufactured by Robert Bosch Corporation, the control of which is described in detail below. Controlled quantities of the air-fuel mixture are communicated to main passage 23 through transfer ports 33 for release into manifold 38 (FIG. 1). The air-fuel mixture is thereafter periodically communicated through valve 40 for combustion in cylinder 16.

Figure 3:
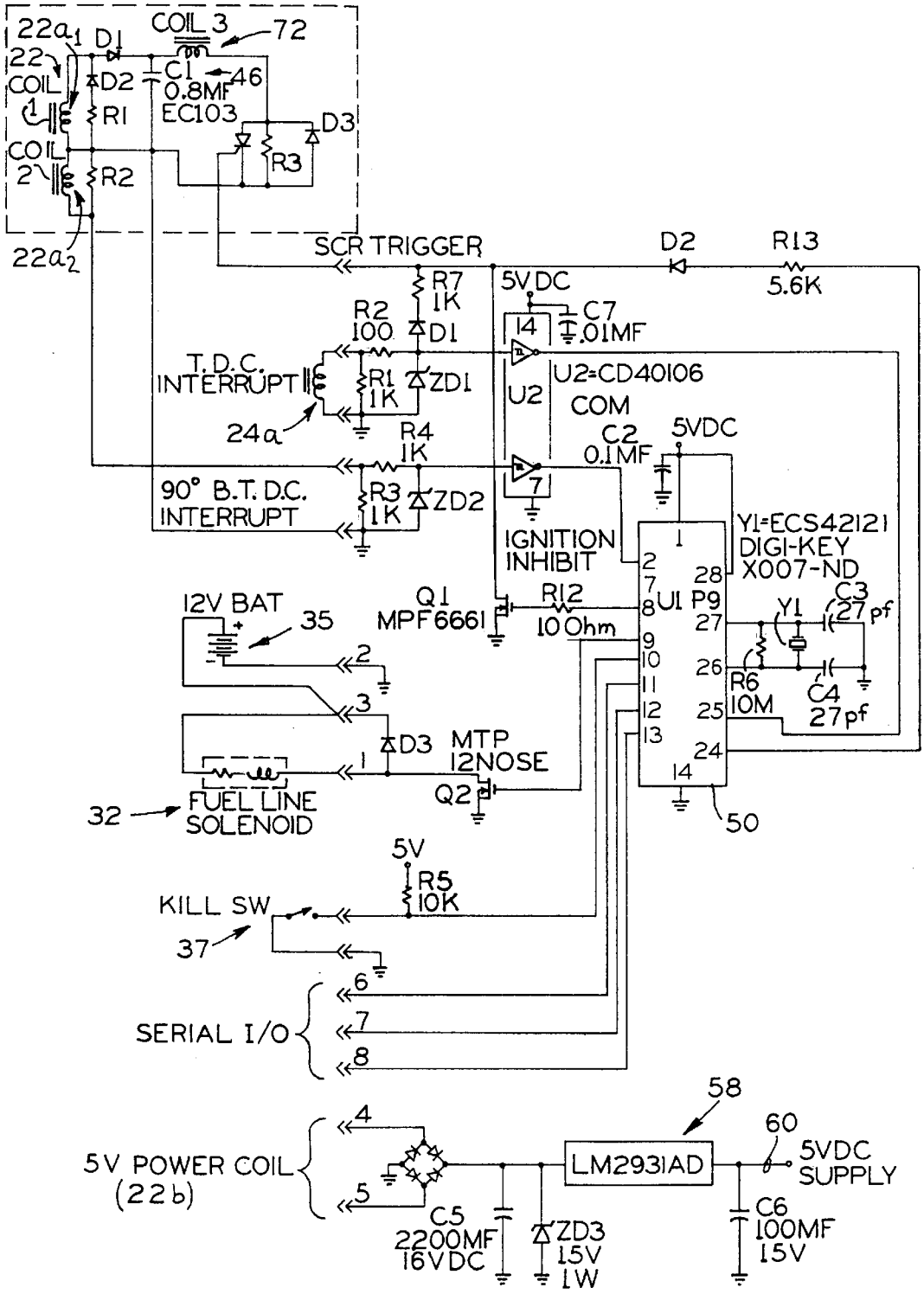
FIG. 3 is a circuit diagram of the electronic feedback carburetor of FIG. 1 utilizing an external battery power supply.

As shown in the embodiment of FIG. 1, spark plug 26 and air solenoid 32 are controlled by an electrical control system, generally designated by the reference numeral 42. Electrical control system 42 receives timing inputs in the form of electrical pulses which are generated when ignition magnet 20 passes in proximity of charge coil laminations 22 and trigger coil laminations 24. The windings 22$a_1$, 22$a_2$, and 22*b* of charge coil laminations 22, are split into three outputs (44, 45 and 56). Output 44 is electrically connected to an ignition capacitor 46. Ignition capacitor 46, which stores electrical energy for discharge to either air solenoid 32 or spark plug 26, is connected to spark/fuel select switch 48. Engine control unit (ECU) 50, which is comprised of such components as the Motorola 6805 family and in particular microprocessor part number XC68HC05P9, controls spark/fuel select switch 48 via select signal 52. ECU 50 is a commonly used device for a variety of engine control applications and includes a microprocessor, memory, and various timing and control circuits. Output 44 is also routed as feedback signal 54 to ECU 50. Feedback signal 54 has a period associated with it which are indicative of various engine performance parameters as described more fully below. Output 56 of charge coil 22 is connected to voltage regulator 58, which, as shown in FIG. 3, includes a standard diode bridge rectifier, a filter section, and further regulator such as Motorola LM 2931 AD. During normal operation, regulator 58 converts the electrical pulses from charge coil 22 into a substantially constant voltage, such as 5 volts direct current, on line 60 which powers ECU 50.

Coil 24*a* is connected to trigger control block 62 and, as will be further explained herein below, controls the operation of spark plug 26 during engine start-up. Control output 64 of ECU 50 is also connected to trigger control block 62 to control the operation of spark plug 26 and air solenoid 32 after engine start-up. Trigger control block 62 contains spark control switch 66 and air bleed control switch 68. Spark control switch 66 is connected between spark pole 70 of spark/fuel select switch 48 and the primary winding of spark transformer 72. Air bleed control switch 68 is similarly connected between air bleed pole 74 of spark/fuel select switch 48 and the primary winding of air bleed transformer 76. Each primary winding terminates in a connection to circuit ground 78. The secondary winding 72*a* of spark plug transformer 72 is connected between circuit ground 78 and spark plug 26 and provides primary ignition of the spark plug. The secondary winding 76*a* of air bleed transformer 76 is connected and provides power, such as 12 vdc, to air solenoid 32. As illustrated in FIG. 3 and discussed below, power to the solenoid may be supplied by an external battery in lieu of transformer 76. As should be apparent to one skilled in the art, spark/fuel select switch 48 and trigger control block 62, which are shown in an exemplary manner in FIG. 1 as mechanical switches, could readily be replaced by functionally equivalent solid state devices.

The operation of the present invention as depicted in FIGS. 1 and 6 begins by manually rotating crankshaft 12 such as by pulling a recoil starter rope (not shown). The vacuum created within carburetor main passage 23 as crankshaft 12 rotates is communicated through transfer ports 33 to mixing chamber 36. During engine start-up, the vacuum in mixing chamber 36 draws the maximum quantity of fuel from fuel float bowl 25. At engine start-up, air solenoid 32 is not initially actuated so as to bleed off a portion of the vacuum to atmosphere. During engine operation, valve 40 opens at the appropriate point in the combustion cycle to communicate the air-fuel mixture from manifold 38 to cylinder 16. Rotation of crankshaft 12 also causes rotation of flywheel 18 which carries ignition magnet 20. As ignition magnet 20 passes charge coil lamination 22, electrical pulses are generated at outputs 44, 45, and 56. The pulse at output 44 is stored across ignition capacitor 46. Spark/fuel select switch 48 defaults to spark position 70 (as shown in FIG. 1). Accordingly, the charge across ignition capacitor 46, approximately 250 Vdc, is also present at the input of spark control switch 66 in trigger control block 62. Initially, the electrical pulse at output 56 is insufficient to generate the necessary power level at the output of voltage regulator 58 as required for ECU 50 operation. Consequently, feedback signal 54, which corresponds to charge coil output 45, is not interpreted by ECU 50.

As ignition magnet 20 rotates past trigger coil laminations 24, the resulting electrical pulse is transmitted to trigger control block 62. This pulse closes spark control switch 66, thereby discharging ignition capacitor 46 across the primary winding of spark transformer 72. The resulting voltage drop across the primary winding generates a voltage across the secondary winding of spark transformer 72 of sufficient strength to activate spark plug 26. Spark plug 26 ignites the compressed air-fuel mixture within cylinder 16 and begins the power stroke of the engine.

On the return (exhaust) stroke, ignition magnet 20 again passes charge coil laminations 22 and again charges ignition capacitor 46 in the manner described above. When ignition magnet 20 passes trigger coil laminations 24 at the top of the exhaust stroke, spark control switch 66 is again enabled and spark plug 26 discharges within cylinder 16. This spark is commonly referred to as the waste spark because it performs no useful function. Piston 14 coasts through the intake and compression strokes, powering flywheel 18 through another revolution. Ignition capacitor 46 is again charged by charge coil 22$a_1$, and discharged by trigger coil 24*a* at the top of the compression stroke. As should be apparent from the foregoing, because air solenoid 32 is not actuated during engine start-up, the air-fuel mixture delivered to cylinder 16 is at maximum richness, which is advantageous for proper engine start-up.

As the speed of crankshaft 12 increases, the series of pulses from charge coil laminations 22 via secondary 22*b* to voltage regulator 58 becomes sufficient to power ECU 50. Under control of a software program, discussed below and as illustrated in the flow charts of FIGS. 8A–11, ECU 50 monitors the output of 22$a_2$, as feedback signal 54 to determine the speed, loading and stability of the engine as explained below. According to these engine parameters, ECU 50 initiates a procedure for controlling air solenoid 32 to optimize the leanness of the air-fuel mixture.

Figure 5A:
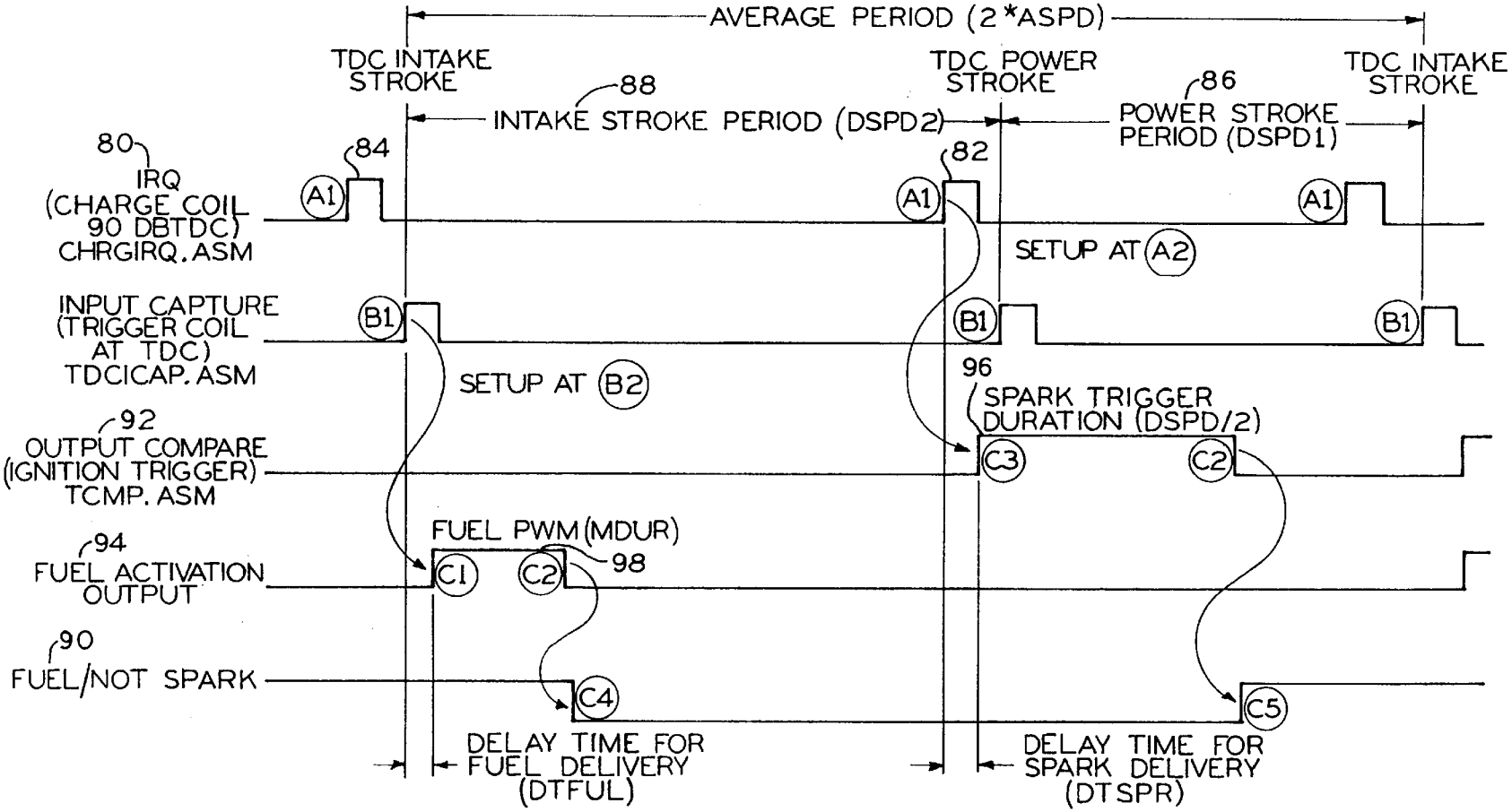
FIG. 5A is a first timing diagram illustrating engine control signals during normal operation.
Figure 5B:
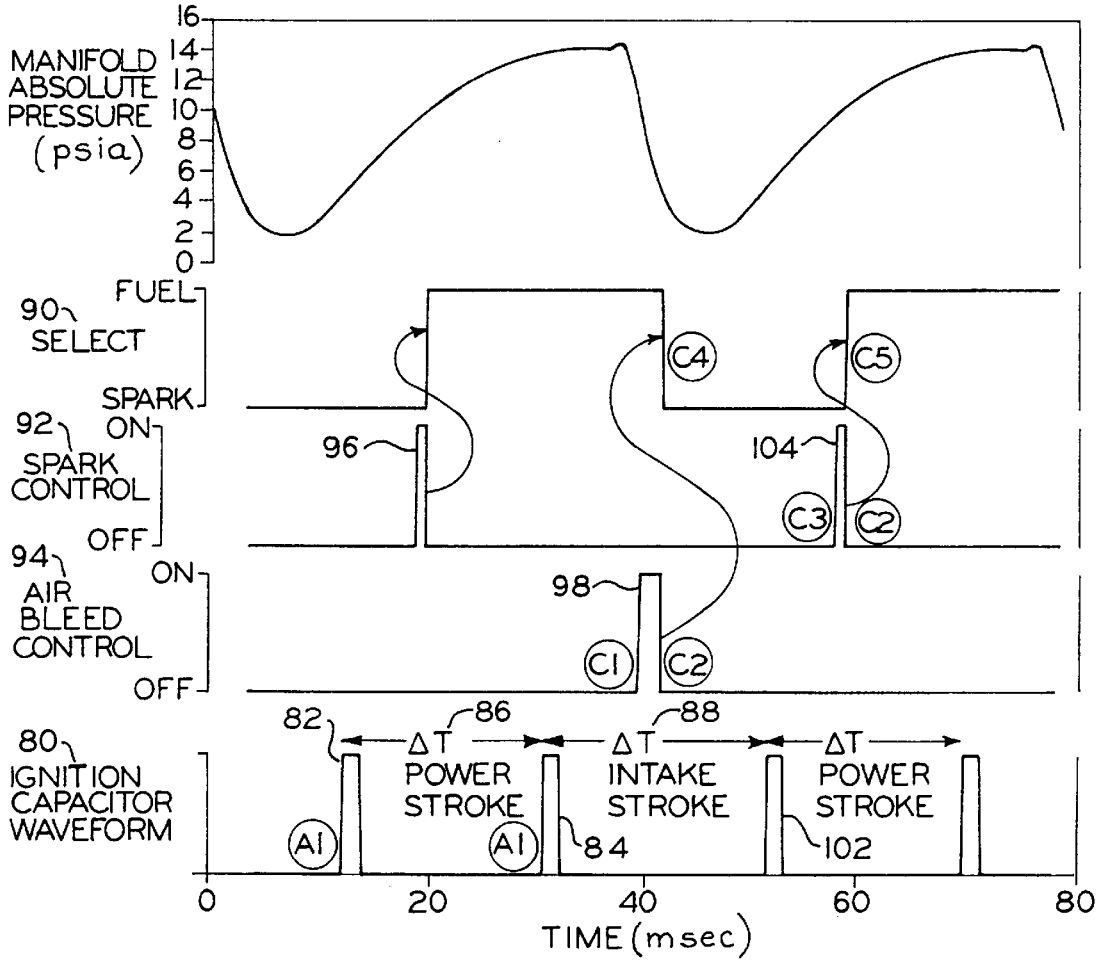
FIG. 5B is a second timing diagram illustrating engine control signals during normal operation.

FIGS. 5A and 5B depict the relative timing of control signals generated by control system 42 after engine start-up. As shown in FIG. 5B, ignition capacitor waveform 80 corresponds to the pulses created by ignition magnet 20 at output 44 of winding 22$a_1$. As explained above, this signal charges ignition capacitor 46 and provides feedback signal 54 to ECU 50. The initial pulse 82 of ignition capacitor waveform 80 corresponds to the pulse generated when ignition magnet 20 rotates past charge coil 22 at the beginning of the compression stroke. The second pulse 84 represents the pulse generated during the next revolution of flywheel 18, at the beginning of the exhaust stroke. Accordingly, time period 86 encompasses the compression/power revolution of flywheel 18 and time period 88 encompasses the exhaust/intake revolution of flywheel 18. Select waveform 90 corresponds to the position of spark/fuel select switch 48. Spark control waveform 92 and air bleed control waveform 94 correspond to the outputs of spark control switch 66 and air bleed control switch 68, respectively. The duration of the pulses comprising spark control waveform 92 and air bleed control waveform 94 is directly related to the duration of control output signal 64 from ECU 50, as will be further described below.

ECU 50 synchronizes its operations after power-up by identifying the stroke of piston 14 based on ignition capacitor waveform 80 (intake stroke recognition). Since the engine always works against some load, when the engine coasts, it will experience deceleration. This deceleration is most pronounced during the intake/compression revolution. Consequently, the time required to complete an intake/compression revolution (time period 88) will always be greater than the time required for a power/exhaust revolution (time period 86). Thus, ECU 50 recognizes the stroke of the engine by calculating the elapsed time between pulses of ignition capacitor waveform 80 (feedback signal 54 on FIG. 1).

FIGS. 5A and 5B depict the operation of control system 42 over an entire engine cycle after engine start-up. Assume stroke recognition is accomplished and, based on information gleaned from feedback signal 54, ECU 50 determines a leaner air-fuel mixture would enhance engine performance. Beginning at the left of FIG. 5B, select waveform 90 shows spark/fuel select switch 48 in its default (spark) position 70. When ECU 50 receives pulse 82 as feedback signal 54, it recognizes that piston 14 is at the beginning of its compression stroke and calculates the elapsed time required for piston 14 to reach a desired sparking position relative to the top of the stroke. Pulse 82 also creates a charge, such as approximately 250 Vdc, across ignition capacitor 46. When the calculated time period has elapsed, ECU 50 provides control output signal 64 to trigger control block 62, thereby closing spark control switch 66. Closure of spark control switch 66 discharges ignition capacitor 46 across the primary winding of spark transformer 72 and creates spark control pulse 96. Pulse 96 activates spark plug 26 to ignite the compressed air-fuel mixture within cylinder 16. Immediately upon disabling spark control switch 66, ECU 50 toggles spark/fuel select switch 48 to fuel position 74 as shown by select waveform 90.

Pulse 84 of ignition capacitor waveform 80 signals the beginning of the exhaust stroke. ECU 50 calculates the estimated time required for piston 14 to complete the exhaust stroke. Near the end of the exhaust stroke, ECU 50 generates control output signal 64 (shown as pulse 98 of air bleed control waveform 94) which enables air bleed control switch 68. Ignition capacitor 46 discharges across air bleed transformer 76. The resulting voltage across the secondary winding of air bleed transformer 76 actuates air solenoid 32. The duration of pulse 98 determines the length of time bleed valve 100 is opened to atmosphere. When bleed valve 100 is opened, the vacuum within mixing chamber 36 is reduced and a reduced quantity of fuel is drawn from the idle fuel delivery circuit. This increases the leanness of the air-fuel mixture. Accordingly, by varying the duration of the pulses comprising air bleed control waveform 94, ECU 50 can adjust the air to fuel ratio depending upon the current engine operating conditions.

Immediately after applying air bleed control pulse 98, ECU 50 toggles spark/fuel select switch 48 back to spark position 70. Piston 14 then travels through the intake stroke, drawing the leaner air-fuel mixture into cylinder 16. As the cycle repeats, pulse 102 signals the beginning of the compression stroke and provides the cue from which ECU 50 times the next spark control pulse 104 to ignite the compressed mixture. As should be apparent from the foregoing, the pulses generated by trigger coil 24 after engine start-up are not used to ignite spark plug 26 or to actuate air solenoid 32.

ECU 50 calculates the desired leanness of the air-fuel mixture and manipulates the duration of the air bleed control pulses, based on the timing of the pulses comprising ignition capacitor waveform 80, to achieve the desired air-fuel mixture. The number of pulses received by ECU 50 as feedback signal 54 which occur during a given period of time represents the speed of the engine in terms of flywheel 18 rotations per unit of time. Also, because the time required for piston 14 to coast through the intake and compression strokes changes with changes in resistance to engine rotation (loading), the difference between time period 88 and time period 86 relative to previous measurements provides an indication of the present loading on the engine. Finally, ECU 50 determines engine stability by monitoring changes in time period 86 of ignition capacitor waveform 80 from one cycle to the next. These parameters, all derived from waveform 80, are used by the ECU software under high load conditions to bypass the leanness adjustment operation described above to keep temperatures and oxides of nitrogen emissions low, and under low load conditions to actuate air solenoid 32 to achieve the proper leanness adjustment to keep carbon monoxide and hydrocarbon emissions low.

The circuit diagram of FIG. 3 illustrates the solenoid embodiment of FIG. 1 with the exception that external battery power supply 35 provides power to actuate solenoid 32 in lieu of transformer 76. Charge coil laminations 22 is the first coil hit in the sequence which will charge capacitor 46 for use in engine ignition. As the engine is being started, there is now power to the ECU to activate the ignition inhibit line, so power in the capacitor will be channeled to the ignition primary coil 72 when a valid trigger occurs at SCR EC103. This trigger could come from two sources, trigger coil 24*a* (labeled TDC Interrupt in FIG. 3), or the ignition line from pin 24 of the ECU. When the engine is in startup mode, trigger coil 24*a* will supply the trigger for engine ignition, and the ignition timing will be at TDC which is retarded from normal engine operation, but is advantageous for starting purposes. After the engine comes up to operating speed, the ECU will start advancing the ignition trigger to precede the trigger coil event. The trigger coil will still supply a pulse to the SCR (EC103), but the charge would have already been dumped from the ignition capacitor to the primary coil. Primary coil 72 supplies power to secondary coil 72*a* of sufficient number of windings to produce the high voltage necessary to ignite spark plug 26. Kill switch 37 is provided to terminate engine operation.

When flywheel magnet 20 passes charge coil (Coil 1), it also passes a sensing coil $22a_2$ (Coil 2) used as a 90 degree before TDC sensor for the ECU. This signal is valuable for getting precise ignition timing control when the ECU takes over ignition timing events. In addition, trigger coil 24*a* (TDC interrupt) is also used as a sensor connected to the ECU for engine speed, torque, and stability sensing which is explained in the software design description below. Fuel bleed solenoid 32 is activated via control line (9) from the ECU. Again, the description relating to software design explains the events behind the actuation of the fuel solenoid. Finally, filtered and regulated power supply 58 is generated off secondary separate power coil 22*b* for providing a 5 Vdc power supply to the ECU. Between the TDC interrupt and the 90° before TDC interrupt and ECU 50 is disposed an inverter with Schmidt trigger U2, which transforms the slow transition signal received into a fast transition signal and acts like a latch to prevent the inputs to the ECU from becoming unstable.

Figure 2:
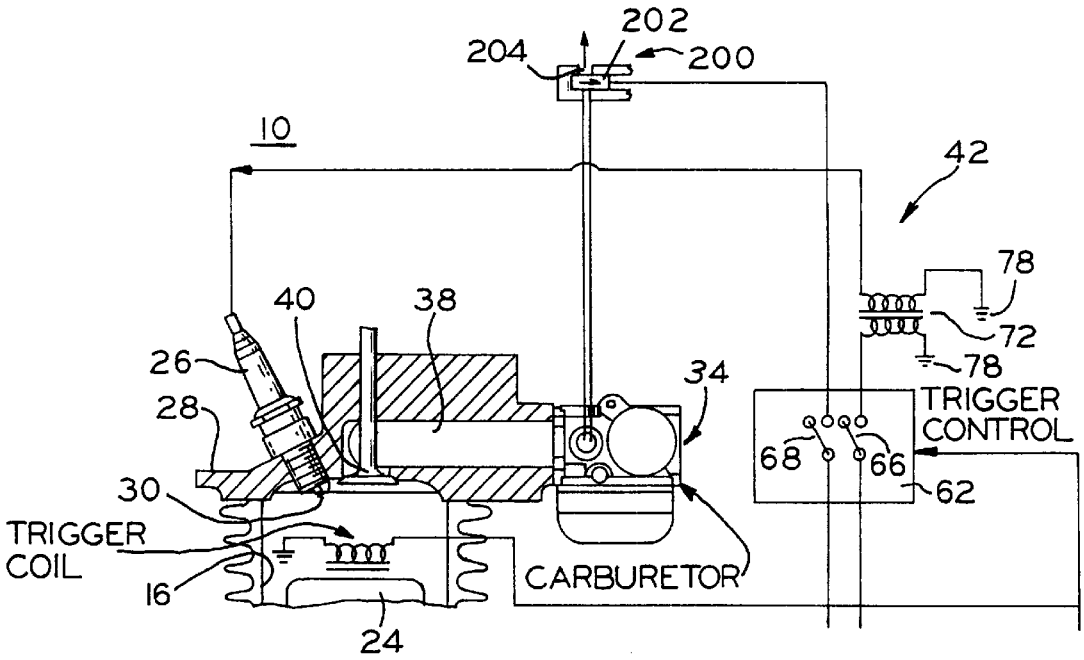
FIG. 2 is an alternative embodiment of the electronically controlled carburetor of FIG. 1 utilizing a piezo-electric actuator device for trimming the air mixture.

In an alternate embodiment of the invention, as shown in FIG. 2, air solenoid 32 and air bleed transformer 76 are substituted with piezo-electric (PZT) actuator 200. PZT actuator 200 includes a movable part 202 formed of piezo-electric material which elongates and retracts linearly within actuator 200 in response to voltage applied by the output of air bleed control switch 68. As movable part 202 changes dimension with applied voltage, it opens or closes orifice 204. When orifice 204 is opened, part of the vacuum within mixing chamber 36 is vented to atmosphere, thereby leaning the air-fuel mixture as described above, The lower power consumption associated with actuator 200 permits the application of air bleed control pulses of substantially longer duration given the same charge across ignition capacitor 46.

Figure 4:
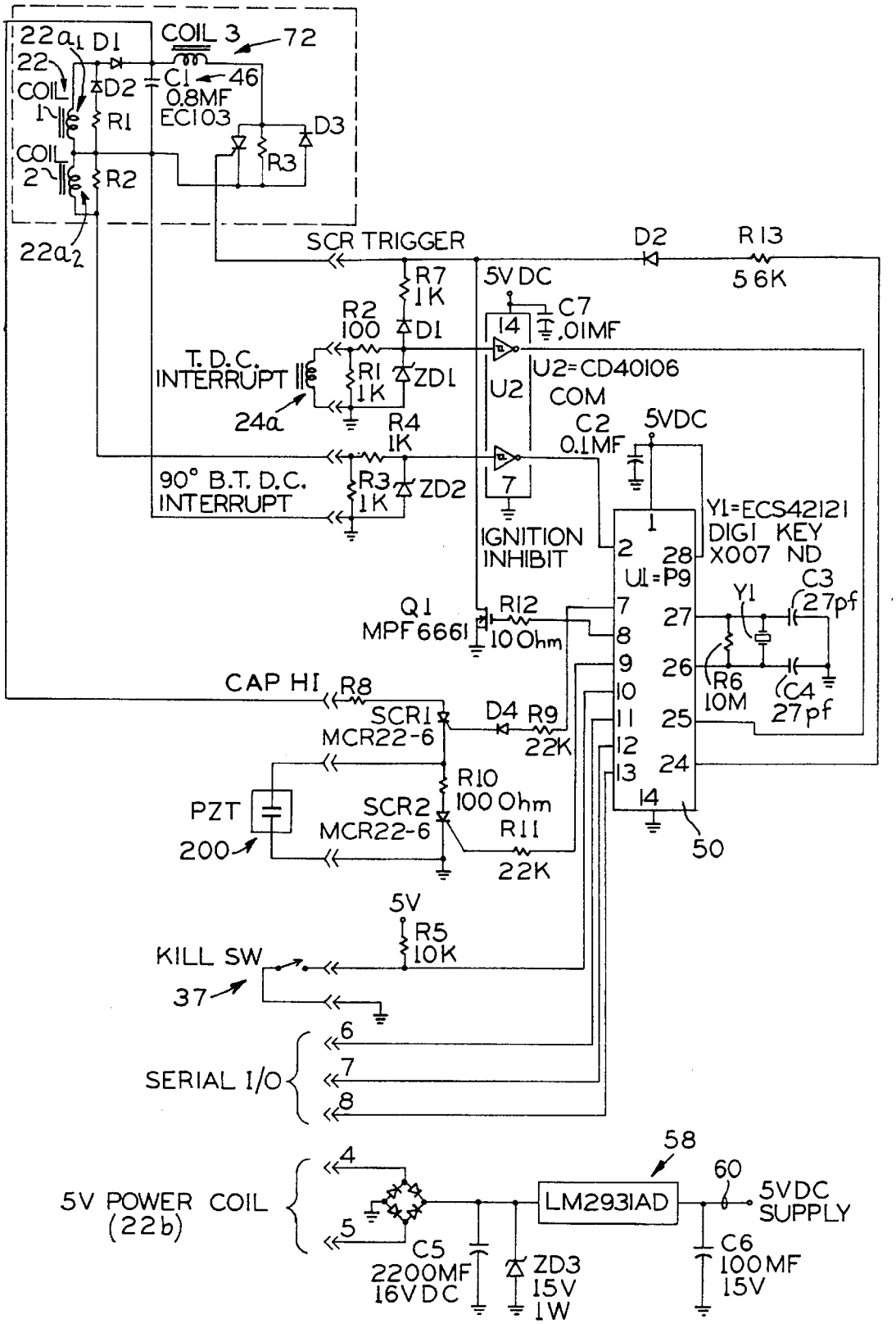
FIG. 4 is a circuit diagram of the electronic feedback carburetor of FIG. 2.

The piezo-electric actuator embodiment of the circuit, as shown in FIGS. 2 and 4, is very similar to the solenoid actuator version. The differences involve the power supply for the actuator, and the addition of a discharge line for the actuator. The power requirements for the PZT style actuator are different from the solenoid actuator in that the voltage is much higher at 250 volts instead of 12 volts. This voltage requirement is well suited to the ignition capacitor for a conventional capacitive discharge (CD) ignition. Therefore, FIG. 4 shows a connection between the ignition capacitor (46) and the supply to the PZT-ON switch (SCR1). High impedance is another characteristic of the PZT actuator that makes it necessary to supply an off switch for the actuator (SCR2) in addition to the on switch (SCR1).

The following is a functional description of the feedback carburetor software implemented with the Motorola 6805 microprocessor driven ECU to operate the solenoid actuator. This description is broken into sections on high level design (which describes the input and output to the processor and the function of the four software routines), the intake stroke events, the events between the intake stroke and power stroke, and finally the power stroke events. As shown in FIGS. 3 and 4, serial I/O ports are provided to connect ECU 50 to an external device for calibration and diagnostics functions as well as for altering the programming of parameters and commands stored in the ECU.

With respect to high level design, the control input signals include digital interrupts for 90 degrees before-TDC (IRQ) and for TDC (ICAP). These signals trigger independent interrupt routines in the microprocessor called CHRGIRQ.ASM and TDCICAP.ASM, as illustrated in the flow charts of FIGS. 9 and 10, respectively.

The output signals include the ignition/solenoid actuator line on the output compare of the microprocessor (TCMP) and the fuel/NOT spark select line. The TCMP line is activated by TDCICAP on the intake stroke and CHRGIRQ on the power stroke. Both TDCICAP and CHRGIRQ activate a timer that will generate an interrupt when it times out. The TCMP line is de-activated by the timer interrupt-service-routine TCMP.ASM when the timer times out.

Figure 8A:
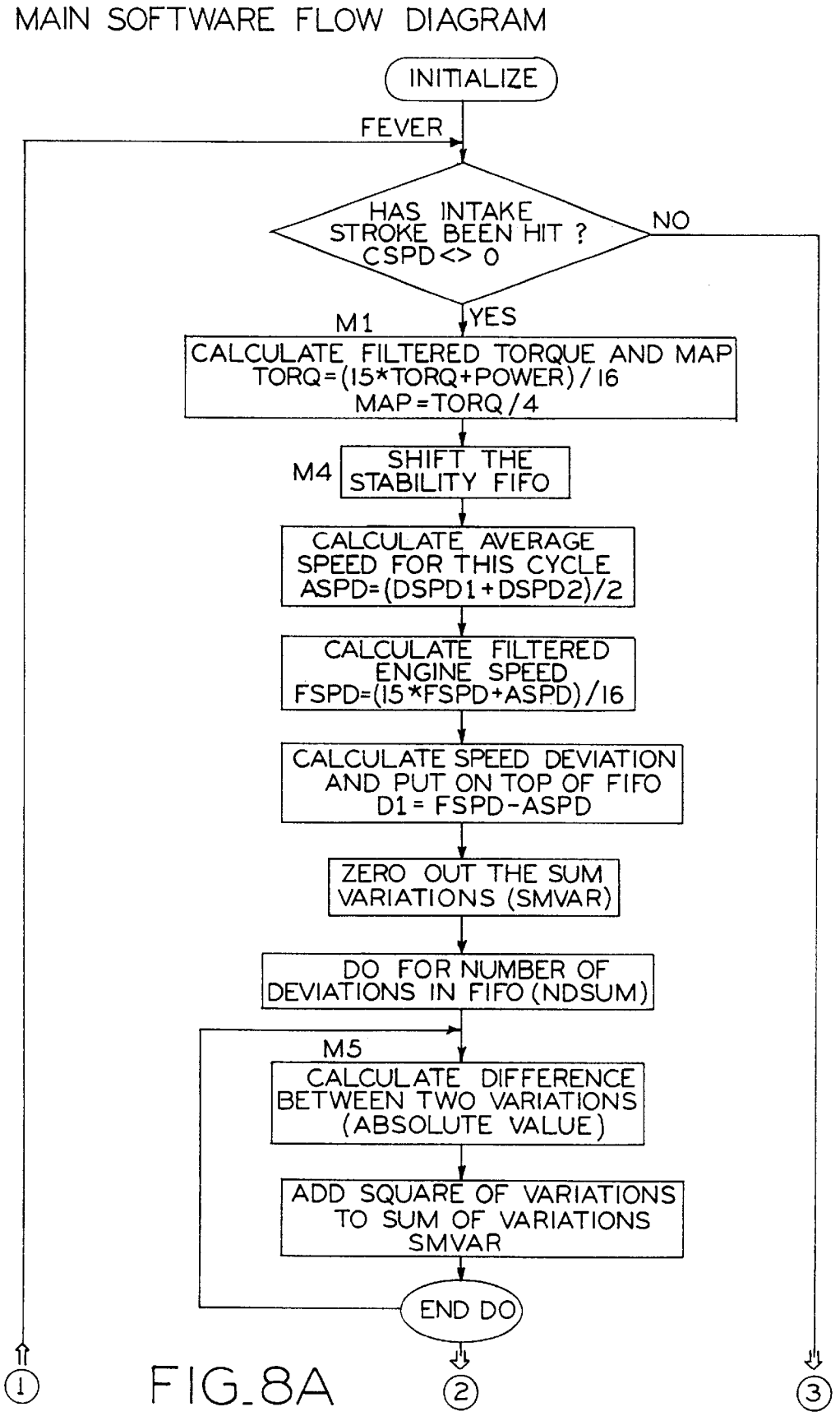
FIG. 8A is a first flow chart illustrating in part the primary feedback carburetor control sequence.
Figure 8B:
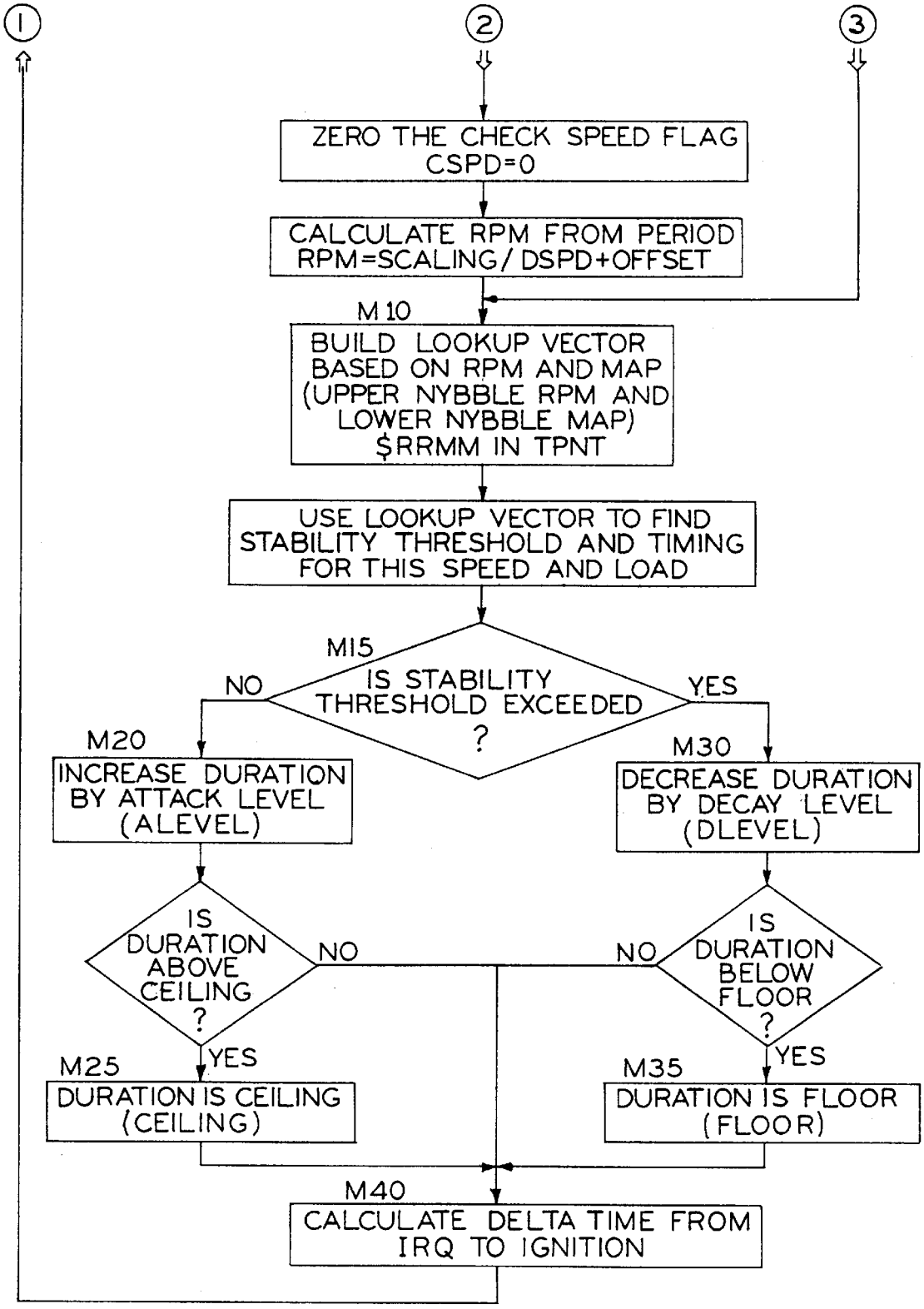
FIG. 8B is a second flow chart illustrating the remainder of the primary feedback carburetor control sequence of FIG. 8A.
Figure 9:
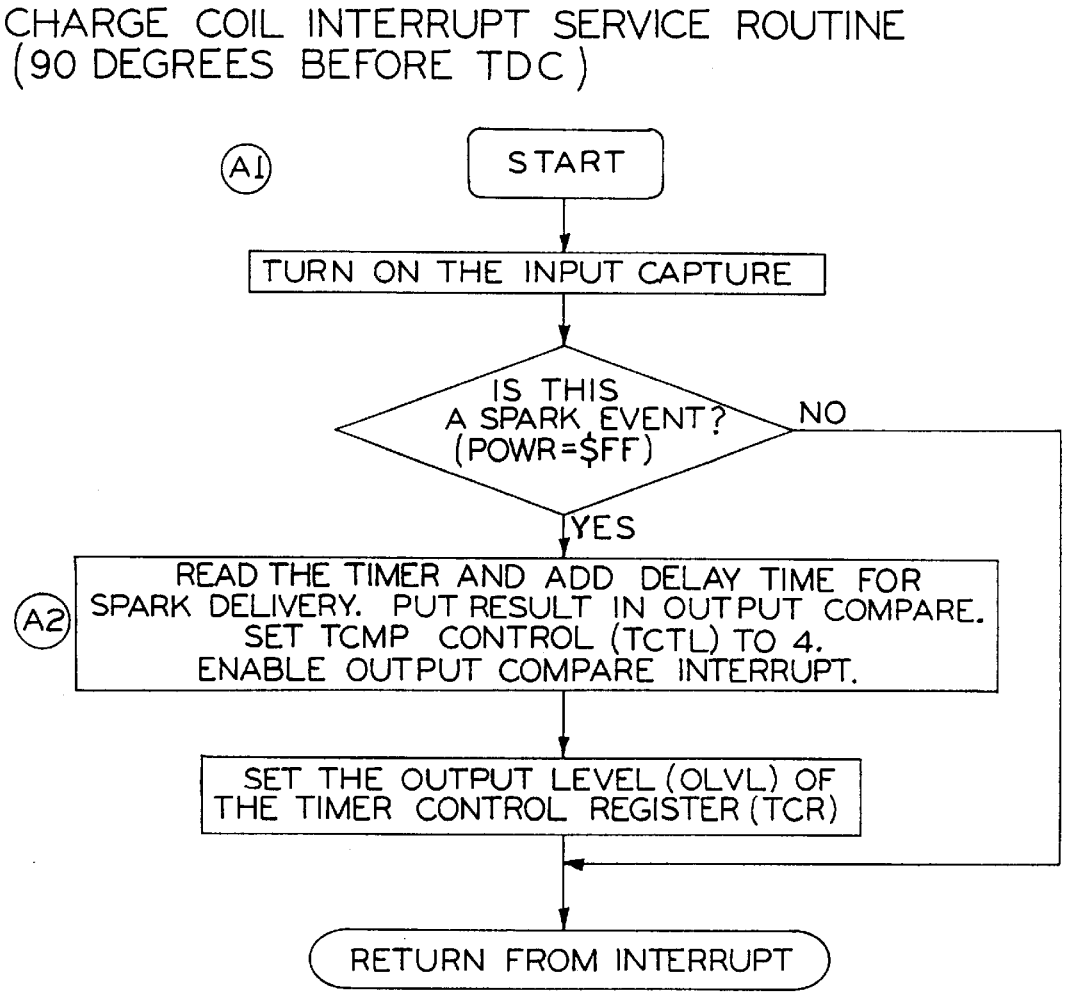
FIG. 9 is a flow chart illustrating the charge coil interrupt service routine associated with the carburetor control device of the present invention.
Figure 10:
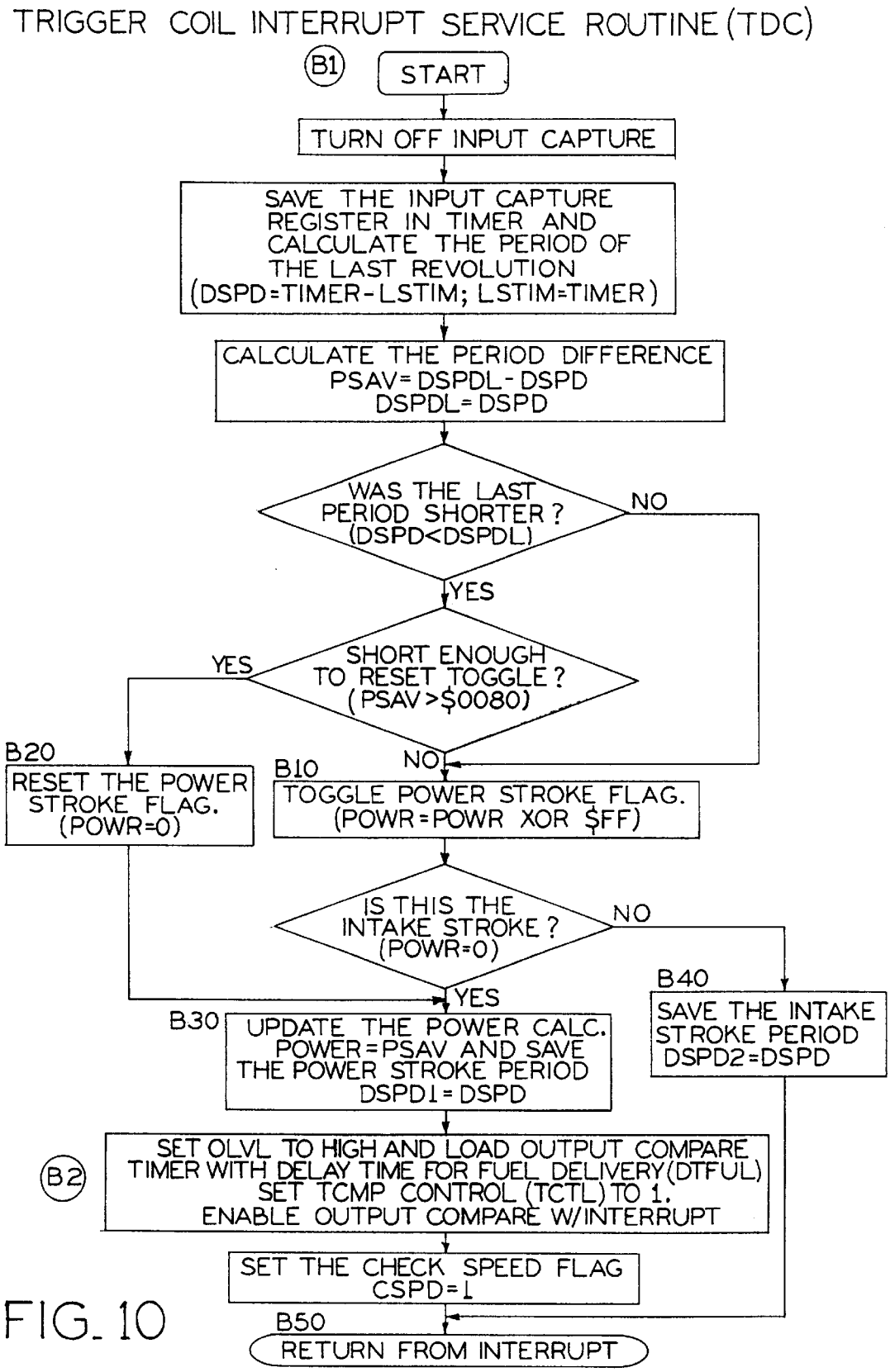
FIG. 10 is a flow chart illustrating the trigger coil interrupt service routine associated with the carburetor control device of the present invention.
Figure 11:
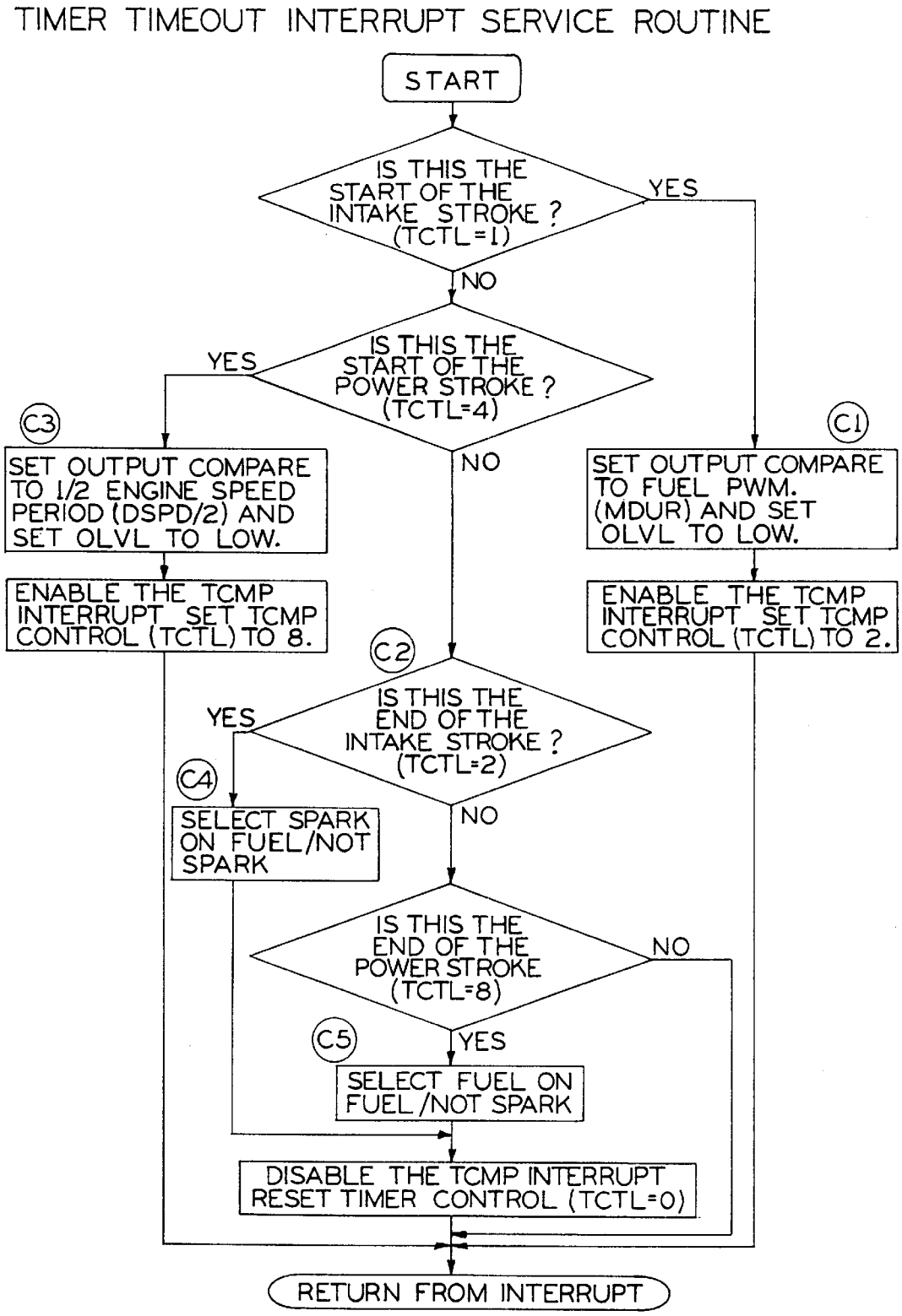
FIG. 11 is a flow chart illustrating the timer timeout interrupt service routine associated with the carburetor control device of the present invention.

The main routine FBCARB.ASM, as illustrated in the flow chart of FIGS. 8A and 8B, is responsible for calculating the current engine conditions including engine torque, speed, and stability value for air-to-fuel mixture control. It does this by calculating the average engine speed and torque based on the TDC timing signal. It compares the average speed to the instantaneous speed to determine a value for the engine stability. Then it uses the average torque and speed in a two-dimensional lookup table to lookup both the ignition timing and threshold stability criteria. The current stability value is compared to the threshold stability criteria for this speed and load, and the duration of the air bleed solenoid is changed accordingly. If the engine is considered to be too unstable for the current speed and load, the solenoid open time is decreased by the decay level, otherwise the solenoid open time is increased by the attack level.

The following is a description of the sequence of events surrounding an intake stroke that occur as shown in the timing diagram (FIG. 5A), including the response of the different software routines FBCARB, CHRGIRQ, TDCICAP and TCMP. The first event in the sequence with the engine functioning at bottom dead center before the exhaust stroke would be the IRQ signal that occurs at 90 degrees before the TDC. This signal will activate the CHRGIRQ routine at Al in the timing diagram (also referenced A1 on the flow chart for CHRGIRQ). The first job of CHRGIRQ (referring to FIG. 9) is to enable the next TDC signal to generate an interrupt with the TDCICAP routine, as described below. CHRGIRQ will then look at the power stroke flag (POWR) and since this is not the power stroke, the routine is bypassed. The next external event would be the TDC signal, which activates the TDCICAP routine at B1.

The first thing TDCICAP (FIG. 10) does is turn off the interrupt trigger capability for TDCICAP so that any electrical noise on the triggering line does not double-trigger this routine. TDCICAP trigger capability is turned back on by the CHRGIRQ routine. TDCICAP will save the current timer for engine speed, torque, and stability calculations in the FBCARB routine, then it will test if the last TDC to TDC period was shorter than the previous period. Since this is the start of the intake stroke, the period should be shorter (the last revolution was a power stroke). Therefore, a subsequent test will see if the difference between the periods was large enough to decisively set the power stroke indicator flag (POWR) at B20 in the TDCICAP flow diagram. If the difference between the periods is not very large, the power stroke indicator flag is merely toggled between power and intake at B10 in the TDCICAP flow diagram. Since this is currently the start of the intake stroke, control continues at B30 of the TDCICAP flow diagram. The speed for the last revolution is retained as the power stroke engine speed, and the output compare timer is set to trigger for the start of the fuel pulse-width-modulation (PWM). Since the fuel event is just starting, this timer is set very short in order to get the solenoid open as soon as possible. This event is labeled as B2 on the timing diagram and the TDCICAP flow diagram. A control variable (TCTL) is set to one to instruct the TCMP routine that it is acting on the start of an intake stroke PWM. A Check-Speed flag (CSPD) is set to instruct the main routine to calculate the speed and torque. These calculations are done in the main routine to keep the interrupt processing time to a minimum, and the main routine can perform these tasks while waiting for the next event to happen. The TDCICAP routine terminates and waits for another TDC event to happen. Now the TCMP routine will trigger when the timer triggers from the setup at B2.

The TCMP routine (FIG. 11) is responsible for turning on and off the spark and fuel control lines. At this stage in the cycle, the fuel PWM will be turned on by the combination of the Output-Level signal and the fuel/NOT spark line as determined by the TCMP routine (refer to the TCMP flow diagram). The fuel/NOT spark line was setup from a previous cycle and is pointing to the fuel event. Since this is the start of the intake stroke (as determined by TCTL at B2 in TDCICAP), flow is sent to point C1 where the timer for TCMP is reset to the current PWM level for fuel control (MDUR). The TCMP control variable (TCTL) is set to 2 and the TCMP interrupt capability is left on to the trap the end of the PWM event. The TCMP routine terminates and waits for the PWM to time out thus triggering TCMP again. Upon subsequent triggering, the TCMP control variable (TCTL) transitions from the first value (one) to the next value (two) and flow is diverted to the point C4. The fuel/NOT spark line is now set to select spark and the TCMP interrupt is disabled. The TCMP control variable (TCTL) is reset to zero and the TCMP routine terminates. This is the end of an intake event, and control is returned to the main routine which has been instructed by the CSPD variable at a point B2 of TDCICAP to calculate the current engine speed, torque and stability.

Between the intake and power strokes, the main program FBCARB, FIGS. 8A and 8B, operates in a continuous loop searching for the passing of the intake stroke event. When this occurs, FBCARB calculates the instantaneous torque by multiplying difference between the power stroke period and the intake stroke period by 64. The instantaneous torque is then filtered into the average torque by adding 15 times the average torque to 1 times the instantaneous torque and dividing the result by 16. A similar process is done to calculate instantaneous and average speed, except instead of using the difference between the power stroke and the intake stroke periods, the average of the two periods is used. FBCARB then calculates the stability by adding the square of the differences between the instantaneous speed (for the previous cycle) and the average speed.

A list of the deviations for the last five engine cycles is maintained in a First-In-First Out (FIFO) buffer. The average stability is the summation of the deviations in the FIFO buffer. The upper four bits of the average speed and torque are used in a vector lookup table for the ignition timing and threshold stability criteria. The ignition timing (in crank angle degrees) for this speed and load is extracted from the lookup table and the timer value for spark is calculated taking the current engine speed into account. This timer value is stored for later use by the CHRGIRQ routine at location A2. The stability criteria is extracted from a lookup table again based on load and speed, and the previously made stability calculation is compared to a minimum criteria for the lookup table. If the current engine stability exceeds the criteria from the lookup table, the PWM is decreased by the decay level, otherwise the PWM is increased by the attack level. The PWM is stored for later use by TCMP routine at C1.

The power stroke events are next in the sequence shown in the timing diagram as the second A1 entry on the IRQ line of FIG. 5A. As with the intake stroke events, the IRQ signal triggers the CHRGIRQ routine 90 degrees before TDC and the first job of CHRGIRQ (FIG. 9) is to turn on the interrupt for TDCICAP, but this time the power stroke indicator (POWR) dictates a spark event needs to happen. So the time delay for ignition timing calculated in the main routine is loaded into the timer at location A2. The TCMP control variable (TCTL) is set to 4 to indicate the start of the power stroke to the TCMP routine and the TCMP interrupt enable is activated. Next, the TCMP should time out before the TDC event because ignition timing will always be at or before TDC. TCMP will activate with TCTL set at 4, therefore the new timeout for the TCMP routine is set to ½ the period of an engine revolution so the next TCMP interrupt will happen near engine bottom dead center. To get TCMP to do this, the TCTL has to be set to 8 and the interrupt capability for TCMP is kept active. Next the TDC signal generates an interrupt with the TDCICAP routine.

TDCICAP (FIG. 10) will behave the same as on the intake stroke except that the test for the shorter period should initiate a power stroke and transfer control to the B40 portion of the flow diagram for TDCICAP. Here, the intake stroke period duration is retained instead of the power stroke. In addition, the Check Speed (CSPD) flag is not set during a power stroke, so the main routine does not get a signal to calculate speed and torque as with the intake stroke. Therefore, the next event to process would be the TCMP routine for the timeout near bottom dead center.

When TCMP (FIG. 11) gets triggered for the final time at the end of the power stroke, (TCTL=8) the fuel/NOT spark select line is set for fuel, the TCMP interrupt is disabled, and the TCMP control variable (TCTL) is reset to 0. The process will begin again with the anticipation of the next IRQ at 90 degrees before the TDC.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of controlling an air to fuel mixture to an internal combustion engine having a carburetor, and a bleed device in fluid communication with the carburetor to control the air to fuel mixture supplied to the engine, the steps comprising:

measuring engine timing parameters including an intake stroke period and a power stroke period;

calculating an engine stability value using the engine timing parameters including calculating an instantaneous engine speed, an average engine speed, an instantaneous torque, and an average torque;

comparing the engine stability value to threshold stability criteria to determine if the engine stability value is greater than the stability criteria;

providing an open time signal to the bleed device; and adjusting the open time signal for the bleed device by decreasing the duration of the open time signal if the engine stability value is greater than the stability criteria and increasing the duration of the open time signal if the engine criteria is not greater than the stability criteria.

2. The method of claim 1, wherein the stability criteria is determined by using the average engine speed and the average torque in a look-up table.

3. The method of claim 1, wherein said step of calculating an engine stability value includes adding the square of the differences between a previous instantaneous engine speed and the average engine speed for at most the last five engine cycles to determine the engine stability value.

4. A method of controlling an air to fuel mixture to an internal combustion engine having a carburetor and a bleed device in fluid communication with the carburetor to control the air to fuel mixture to the engine, the steps comprising:

measuring engine timing parameters;

calculating a current instantaneous engine speed, a current average engine speed, a current instantaneous torque, and a current average torque using the engine timing parameters;

calculating an engine stability value using the average engine speed and a previous instantaneous engine speed;

determining a threshold stability criteria using the current average engine speed and the current average torque in a look-up table;

comparing the engine stability value to the stability criteria to determine if the engine stability value is greater than the stability criteria;

providing an open time signal to the bleed device; and adjusting the open time signal for the bleed device by decreasing the duration of the open time signal if the engine stability value is greater than the stability criteria and increasing the duration of the open time signal if the engine criteria is not greater than the stability criteria.

5. The method of claim 4, wherein the engine timing parameters include an intake stroke period and a power stroke period.

6. The method of claim 5, wherein said step of calculating the current engine speed and torque includes multiplying the difference between the power stroke period and the intake stroke period by 64 to obtain the current instantaneous torque and summing fifteen times a previous average torque to one times the current instantaneous torque and dividing the sum by sixteen to obtain the current average torque.

7. The method of claim 5, wherein said calculating the current average engine speeds and torques step includes summing the power stroke period and the intake stroke period and dividing the sum by two to obtain the current instantaneous engine speed and summing fifteen times a previous average engine speed to one times the current instantaneous engine speed and dividing the sum by sixteen to obtain a current average engine speed.

8. The method of claim 7, wherein said step of calculating an engine stability value includes adding the square of the differences between the previous instantaneous engine speed and the current average engine speed for at most the last five engine cycles to determine the engine stability value.

* * * * *